US006223803B1

(12) United States Patent
Nielsen

(10) Patent No.: US 6,223,803 B1
(45) Date of Patent: May 1, 2001

(54) WINDOW WITH A SCREENING DEVICE

(75) Inventor: Elgaard Schandorff Nielsen, Østbirk (DK)

(73) Assignee: Velux Industri A/S, Søborg (DK)

( * ) Notice: Subject to any disclaimer, the term of this patent is extended or adjusted under 35 U.S.C. 154(b) by 0 days.

(21) Appl. No.: 09/427,929

(22) Filed: Oct. 26, 1999

(51) Int. Cl.[7] ..... A47H 1/00
(52) U.S. Cl. ..... 160/98; 160/27; 160/100
(58) Field of Search ..... 160/27, 28, 29, 160/40, 90, 98, 99, 100, 102, 271, 273.1; 16/87 R, 87.6 W, 87.8, 96 L

(56) References Cited

U.S. PATENT DOCUMENTS

| | | | | |
|---|---|---|---|---|
| 739,553 | * | 9/1903 | Mansell | 160/27 |
| 960,388 | * | 6/1910 | Paddison | 160/27 |
| 987,654 | * | 3/1911 | Thompson | 160/27 |
| 1,097,140 | * | 5/1914 | Paddison | 160/27 |
| 1,182,694 | * | 5/1916 | Logan | 160/27 |
| 1,736,668 | * | 11/1929 | Pitcher | 160/27 |
| 3,155,146 | * | 11/1964 | Malouf et al. | 160/27 |
| 3,173,474 | * | 3/1965 | Wootten | 160/27 |
| 3,470,934 | * | 10/1969 | Agnew | 160/100 |
| 3,911,990 | * | 10/1975 | Hoover et al. | 160/100 |
| 4,862,942 | * | 9/1989 | Johnson | 160/99 |
| 4,993,468 | | 2/1991 | Hackman et al. . | |
| 5,544,689 | * | 8/1996 | Wegner | 160/100 |
| 5,671,790 | | 9/1997 | Andersen et al. . | |
| 5,915,443 | * | 6/1999 | Lindley, Jr. | 160/100 |

FOREIGN PATENT DOCUMENTS

| | | |
|---|---|---|
| 23 57 942 | 6/1981 | (DE) . |
| 0 807 199 | 9/1996 | (EP) . |

* cited by examiner

*Primary Examiner*—Daniel P. Stodola
*Assistant Examiner*—Bruce A. Lev
(74) *Attorney, Agent, or Firm*—Venable; John P. Shannon

(57) ABSTRACT

A window with a substantially rectangular main frame structure with an openable sash structure comprises a built-in roller screening device comprising a flexible screening web having one end secured to a spring-loaded roller member and an opposite end connected with a rigid end member. A roller member is received in bracket members at respective ends of a longitudinal cavity formed in one of a first pair of main frame members, whereas in each of second pair of main frame members extending at right angles to the first pair a longitudinal guide track is formed to receive respective ends of said rigid end member and optionally edge regions of the screening web. The cavity is closed against the light-admitting area by a detachable cover member leaving a narrow slit-opening for passage of the screening web and permitting arrangement, removal or replacement.

23 Claims, 2 Drawing Sheets

WINDOW WITH A SCREENING DEVICE

BACKGROUND OF THE INVENTION

The present invention relates to windows with built-in screening devices of the roller type, such as insect screens and roller blinds, and windows prepared for installation of such screening devices.

It is well-known in the art to provide windows with various forms of screening devices such as insect screens, roller blinds or the like.

Conventionally, screening devices of the kind comprising a flexible screening web, one end of which is secured to a spring-loaded roller-member, on which the web is rolled-up in its non-screening position, whereas the other end is secured to a rigid end or bottom member, are more or less visibly arranged in the main frame structure of the window, with the roller member connected with brackets secured to the main frame side members.

In the case of roof or skylight windows it is further necessary to have lateral guide members secured to the main frame side members in order to confine the movement of the screening web to a plane parallel to the inclination of the window pane.

Usually, such screening devices are permanently installed at the window and in most prior art designs the screening device itself as well as lateral guide members, when used, entail a certain reduction of the light-admitting area of the window. An example of such a screening device is known from U.S. Pat. No. 4,993,468 disclosing a screening web which is retractable from a holding container connected with a frame section.

Typically, in the case of insect screens the actual use of the screening device is restricted to certain periods of the year such as the summer time, whereas in other periods the screening device is hardly never used.

To permit the removal of a screening device in periods, when it is not needed, various solutions have been suggested in the prior art. One example is known from U.S. Pat. No. 5,671,790 disclosing a screening device arranged in a collapsible frame structure, which may easily be mounted on existing window frames and disconnected therefrom. In use of this screening device the erected frame structure results in a significant reduction of the light-admitting area and, when not in use the collapsed screening device must be stored in a safe place outside the window area.

SUMMARY OF THE INVENTION

On this background it is the object of the invention to provide a window with a screening device, in which the shortcomings of prior art solutions have been overcome by a permanent screening installation which does not reduce the light-admitting area of the window, when the screening device is not in use, and which can be used also in roof or skylight windows without complicated lateral guide means.

A further object of the invention is to provide a window with a screening device which is uncomplicated and cheap in production and the screening device can be relatively easily removed, e.g. when it is desired to change from an insect screen to a roller blind or vice versa.

According to the invention, these and other objects are met by a window comprising a substantially rectangular main frame structure with main frame members including a top member, two side members and a bottom member, each of said main frame members having a side facing the light-admitting area of the window, at least one of a first pair of said main frame members being formed in said side facing the light-admitting area with a longitudinal cavity for accommodation of a roller screening device of the kind comprising a flexible screening web having one end secured to a spring-loaded roller member and an opposite end connected with a rigid end member, mounting brackets for receiving said spring-loaded roller member being provided at respective ends of said longitudinal cavity, each member of a second pair of opposed main frame members extending at right angles to said first pair of members being provided in said side facing the light-admitting area with a longitudinal guide track to receive respective ends of said rigid end member, said longitudinal cavity being closed at said side facing the light-admitting area by a cover member leaving a narrow slit-opening for passage of the screening web and defining a first end position for the rigid end member in the rolled up condition of the screening device, arresting means being provided for arresting said rigid end member in a second end position in a rolled-out condition of the screening device.

By the accommodation of the screening device in the longitudinal cavity formed in a main frame member and the complete integration of lateral guide tracks in the two frame members which are parallel to the direction of movement of the screening web, there will be no reduction of the light-admitting area of the window when the screening device is in its inactive retracted position, where the entire screening web is rolled-up on the roller member and confined in the cavity In the main frame member.

By proper design of the guide tracks in the frame members parallel to the direction of movement of the screening web the rigid end member of the screening device will be safely guided in any position between the retracted and fully extracted end positions of the screening web. Preferably, also edge parts of the screening web itself will be guided in the tracks, whereby a particular good sealing or blinding effect is obtained.

BRIEF DESCRIPTION OF THE DRAWING

In the following the invention will be further explained by means of a preferred embodiment as shown in the accompanying drawing, in which.

DETAILED DESCRIPTION OP THE INVENTION

Figure 1:
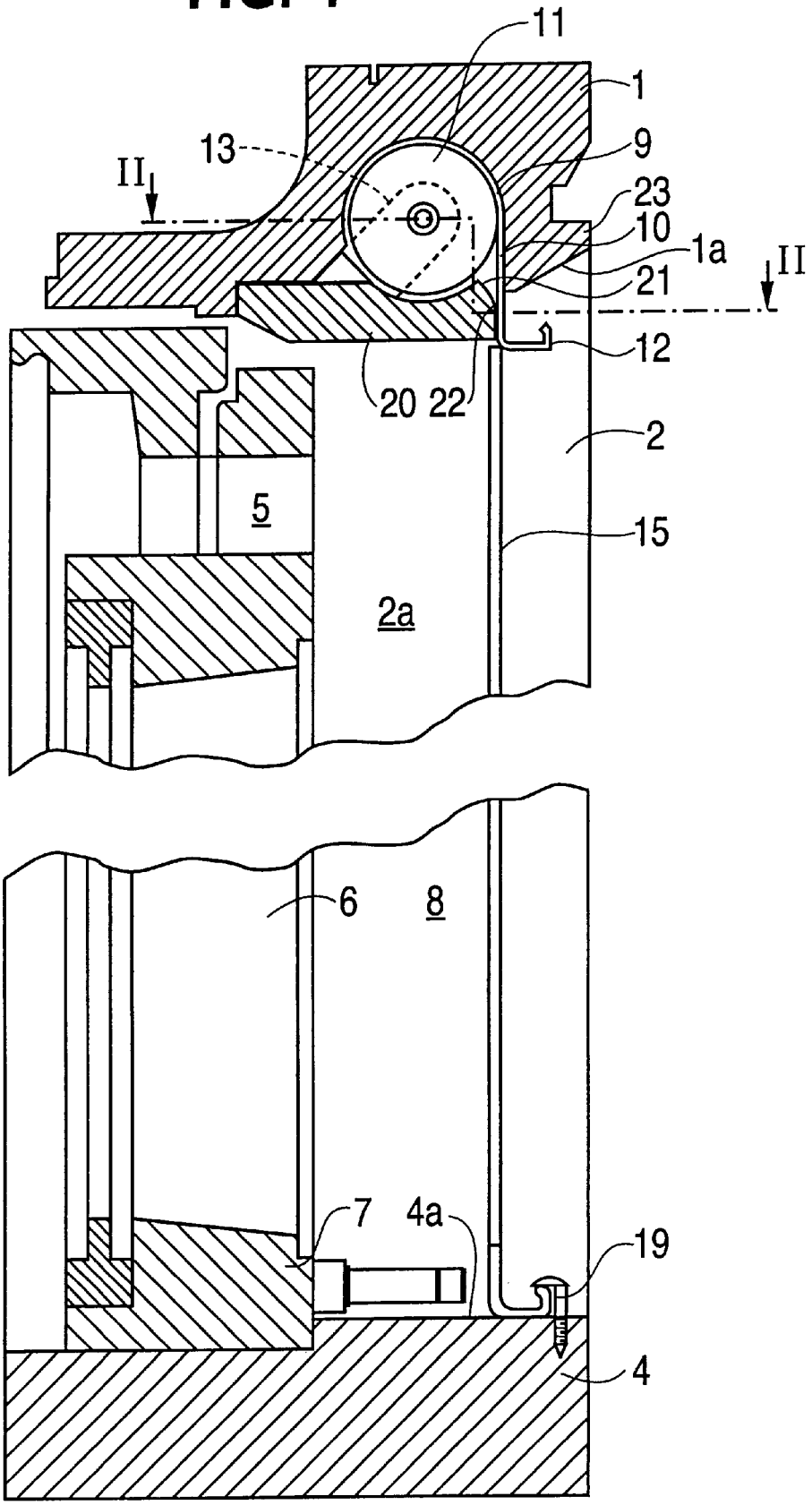
FIG. 1 is a sectional view of parts of an openable window with a screening device according to the invention parallel to the direction of movement of the screening web.
Figure 2:
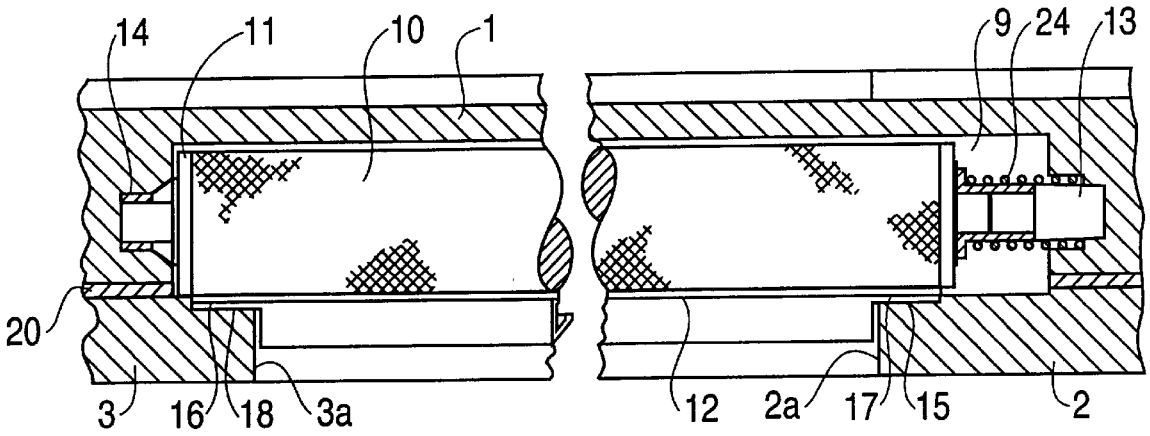
FIG. 2 is a sectional view along the line II—II in FIG. 1.

The window illustrated in the sectional views in FIGS. 1 and 2 is a roof window with a main frame structure composed of a top member 1, two side members 2 and 3 and a bottom member 4. In the illustrated window an openable sash structure composed of a top member 5, side members 6 and a bottom member 7 is supported in the main frame structure to be pivotable by hinge means, known per se and not illustrated, about a pivot axis extending close and parallel to main frame and sash top members 1 and 5.

As will be clear from the following, use of the inventions is not limited, however, to the specific type of window illustrated in the drawing, but may be applied to openable facade windows as well as to windows, be it roof window or facade windows, in which a sash structure is supported in the main frame structure to be pivotable about an axis with a different location such as side or bottom hung windows or is slidably supported with respect to the main frame structure. Moreover, the invention may be used for the installation of screening devices such as roller blinds in stationary windows having no openable sash structure.

Each of main frame members 1 to 4 has a side 1*a* to 4*a*, respectively facing the light-admitting area 8 of the window.

In the side 1*a* of main frame top member 1 a cavity 9 having a substantially circular cross-section is formed throughout the length of top member 1 to receive a roller type screening device of the type known per se, which comprises a flexible screening web 10, one end of which is fastened to a spring-loaded roller member 11, whereas the opposite free end is connected with a rigid end member 12, which in the illustrated embodiment is designed as a substantially L-shaped gripping profile, e.g of aluminium. As well known for such screening devices the spring load acting on roller member 11 produces a force biasing the screening web 10 for movement towards the retracted non-screening position, in which the entire length of the screening web 10 is rolled-up on the roller member 11. The screening web 10 is made of a flexible material selected for the actual purpose of the screening web, which may typically be as an insect screen or a roller blind.

In the cavity 9 the roller member 11 is supported by bracket members 13 and 14 arranged at either end of cavity 9. Conventionally, spring-loaded roller members for screening devices will be provided at least at one end with a pin member of non-circular cross-section, such as a flat rectangular cross-section, to engage a matching recess in a bracket member.

Unlike conventional designs of screened roof windows lateral guiding of the movement of screening web 10 between the retracted, non-screening position and an extracted position, in which the web screens the entire light-admitting area 8 is provided, according to the invention by longitudinal guide tracks 15 and 16, which as shown in FIG. 2 are formed directly in the opposed sides 2*a* and 3*a* of main frame side members 2 and 3 facing the light-admitting area 8.

The guide tracks 15 and 16 receive respective end parts 17 and 18 of the rigid end member 13 of the screening device, the rigid end member 12 being proportioned with a length exceeding the dimension of the light-admitting area 8 between the main frame side members 2 and 3 by an amount such that each of end parts 17 and 18 has a length engaged in the respective guide track 15 and 16 between 10 and 20 mm, preferably about 15 mm. Thereby, the rigid end member 12 will be safely retained in guide tracks 15 and 16 in any position of the screening web 10 and prevented from disengagement from the guide tracks 15 and 16.

As further illustrated in FIG. 2, the screening web 10 has in the illustrated embodiment a width corresponding to the length of the rigid end member 12, so that also edge regions of the web is safely guided and retained in the guide tracks 15 and 16 in any position of the web, even at relatively strong wind loads acting on the web through the window when in its open position. Thereby, an improved sealing and/or blinding effect of the screening device is obtained.

The guide tracks 15 and 16 have a depth and width proportioned to accommodate end parts 17 and 18 of the rigid end member 12 and, optionally the above-mentioned edge regions of the screening web 10. In practice a depth slightly exceeding the length of the corresponding edge part 17 or 18, such as 16 mm and a width of about 3 mm will be suitable to provide for easy low-friction movement of the screening web.

With the width of the screening web 10 corresponding to the length of the rigid end member 12, as explained above, an excellent screening and/or blinding effect is obtained even in the rare situation where one or both edge regions of the screening web may become disengaged from the corresponding guide track, since the excess width of the screening web compared to the width of the light-admitting area will cause the edge region or regions of the screening effect to remain in close contact with main frame side members 2 and 3, almost with a lip seal effect.

As shown in FIG. 1 arresting means, which may comprise a turnable member 19 substantially similar to a conventional sash fastener is mounted on the main frame bottom member 4 for arresting the rigid end member 12 of the screening device in the extracted position of the screening web 10, in which the entire light-admitting area of the window is screened.

It will be appreciated, however, that any conventional type of arresting means for window screening devices may be used such as an operation cord system with a built-in brake effect or with a specific arresting member.

As further seen in FIG. 1 the cavity 9 formed in the main frame top member 1 to receive the screening device is covered on the side facing the light-admitting area 8 by a cover member 20 connected by means known per se and not-illustrated with the main frame top member 1. Thereby, only a narrow slit-like passage 21 is left for the screening web 10 in alignment with the guide tracks 15 and 16 in main frame side members 2 and 3 and a front edge 22 of the cover member 20 will contact the rigid end member 12 in the retracted position of the screening web 10.

Thereby, in the retracted position the only visible part of the screening device will be the rigid end member 12 positioned in close contact against the front edge 22 of the cover member 20 and the part 23 of the main frame top member 1 providing the opposite limitation of the narrow slit-like passage 21 for the screening web.

The cover member 20 may advantageously be detachably connected with the main frame top member 1, e.g. by snap connecting means of a the known per se. Thereby, the window according to the invention may, on one hand, be supplied without a built-in screening device, but ready for easy after installation of the screening device and, on the other hand, easy removal or replacement of the screening device, e.g. replacement of an insect screen by a roller blind or vice versa is made possible.

With the screening device design described above, where the width of the screening web exceeds the width of the light-admitting area of the window between main frame side members 2 and 3 the roller member 11 will have a length exceeding the length of the opening made available by removal of the cover member 19 for arrangement or removal of the roller member 11 with the rolled-up screening web 10 in or from its operating position in the cavity 9. In this case the roller member 11 with the rolled-up web 10 will obviously have to be inserted into the cavity 9 with one end leading which after engaging its respective bracket member 13 will have to be displaced through a sufficient length of the cavity 9 in the longitudinal direction thereof towards one end thereof to allow insertion of the opposite end of the roller member 11 to engage its respective bracket member 14 at the other end of the cavity 9.

To enable such a displacement the bracket member 13 may as schematically indicated in FIG. 2 be arranged to be displaceable in the longitudinal direction of the cavity 9 against a spring-bias produced e.g. by a suitable compression spring 24.

Whereas in the illustrated embodiment the screening device is shown to be accommodated in a cavity formed in the main frame top member 1, it would alternatively be possible to provide for such a cavity in one or the main frame side members of the window with guide tracks for the rigid end member of the screening device being formed in the main frame top and bottom members, or have the cavity formed in the main frame bottom member.

Figure 3:
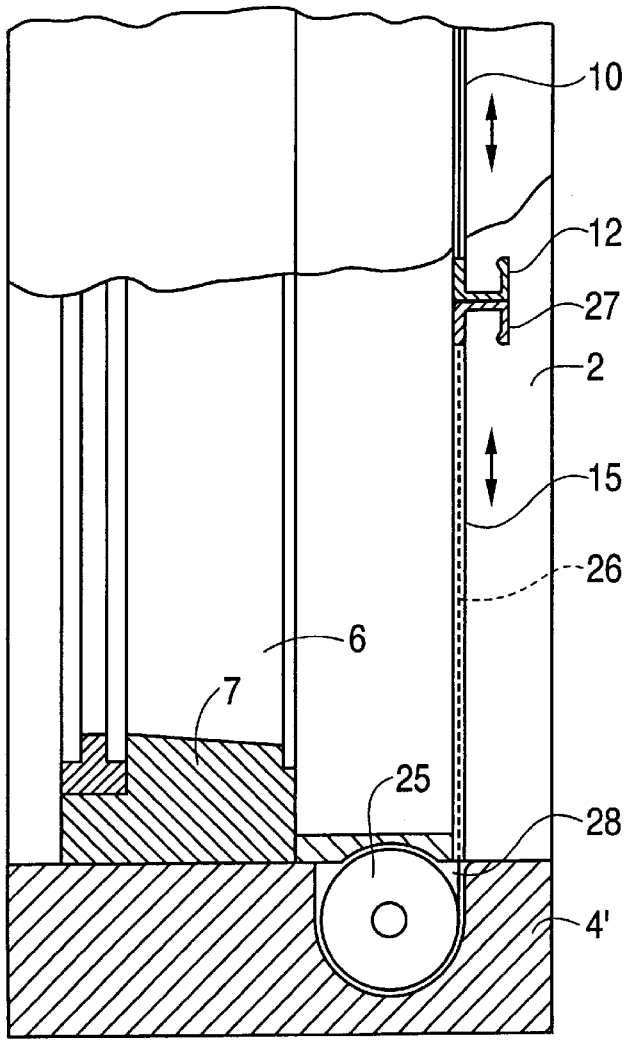
FIG. 3 is a sectional view of an alternative embodiment with two screening devices.

In FIG. 3 a modification of the embodiment in FIGS. 1 and 2 is shown in which an additional screening device comprising a spring-loaded roller member 25, a flexible screening web 26 and a rigid end member 27 is accommodated in a cavity 28 formed in the main frame bottom member 4' to provide a dual-screening similar to a prior art dual arrangement disclosed in European Patent No. 0 807 199. In such a dual arrangement the upper screening device with screening web 10 may suitably be a roller-blind with a light screening effect, whereas the lower screening device with screening web 26 may be an insect screen. To allow interconnection of the rigid end members 12 and 27 of the two screening devices in any parking position throughout the range of movement, the rigid end members 12 and 27 is provided with engaging means which are engageable with each other.

What is claimed is:

1. A window comprising a substantially rectangular main frame structure with main frame members including a top member, two side members and a bottom member, each of said main frame members having a side facing the light-admitting area of the window, at least one of a first pair of said main frame members being formed in said side facing the light-admitting area with a longitudinal cavity for accommodation of a roller screening device of the kind comprising a flexible screening web having one end secured to a spring-loaded roller member, bracket members for receiving said spring-loaded roller member being provided at respective ends of said longitudinal cavity, an opposite end of said screening web being connected with an individual rigid end member, each member of a second pair of opposed main frame members extending at right angles to said first pair of members being provided in said side facing the light-admitting area with a longitudinal guide track to receive respective ends of said rigid member, said longitudinal cavity being closed at said side facing the light-admitting area by a separate cover member connected with said at least one main frame member, a narrow slit-opening for passage of the screening web being defined between a front edge of said cover member and a front part of said at least one main frame member to define a first end position for the rigid end member in the rolled up condition of the screening device, said rigid end member comprising a profile member having a first flange part secured with said opposite end of the screening web and a second flange part providing a gripping member said front part of the at least one main frame member providing an abutment for said profile member and being formed to enable gripping of said second flange part in said first end position, arresting means being provided for arresting said rigid end member in a second end position in a rolled-out condition of the screening device.

2. A window as claimed in claim 1, wherein said first end position of the rigid end member is defined by a longitudinal edge face of said cover member to a position substantially outside the light-admitting area.

3. A window as claimed in claim 1, wherein said cover member is detachably connected with said at least one main frame member.

4. A window as claimed in claim 1, wherein one of said bracket members is arranged in said cavity to be displaceable against a spring-force in the longitudinal direction of the cavity.

5. A window as claimed in claim 1, wherein said arresting means is provided at the other of said first pair of main frame members to arrest said rigid end member in a rolled-out condition, in which the screening device screens the entire light-admitting area.

6. A window as claimed in claim 1, wherein the other of said first pair of main frame members is provided in the side facing the light-admitting area with a longitudinal cavity for accommodation of a second screening device of the same kind as said roller screening device, said cavity being closed at the side facing the light-admitting area by a second cover member, and said guide tracks in said second pair of main frame members receiving the rigid end members of both of said screening devices.

7. A window as claimed in claim 1, wherein an openable sash structure is arranged in said main frame structure.

8. A window as claimed in claim 7, wherein said sash structure is pivotable with respect to said main frame structure about a pivot axis extending along one of said main frame members.

9. A window as claimed in claim 7, wherein said sash structure comprises at least one sash part which is slidably engaged with respect to said main frame structure.

10. A window as claimed in claim 1, wherein said profile member is substantially L-shaped.

11. The combination of a window comprising a substantially rectangular main frame structure with main frame members including a top member, two side members and a bottom member, each of said main frame members having a side facing the light-admitting area of the window, and a roller screening device of the kind comprising a flexible screening web having one end secured to a spring-loaded roller member, at least one of a first pair of said main frame members being formed in said side facing the light-admitting area with a longitudinal cavity for accommodation of said roller screening device with mounting brackets for receiving said spring-loaded roller member being provided at respective ends of said longitudinal cavity, an opposite end of said screening web being connected with an individual rigid end member, each member of a second pair of opposed main frame members extending at right angles to said first pair of members being provided in said side facing the light-admitting area with a longitudinal guide track to receive respective ends of said rigid end member, said longitudinal cavity being closed at said side facing the light admitting area by a separate cover member connected with said at least one main frame member, a narrow slit-opening for passage of the screening web being defined between a front edge of said cover member and a front part of said at least one main frame member to define a first end position for the rigid end member in the rolled up condition of the screening device, said rigid end member comprising a profile member having a first flange part secured with said opposite end of the screening web and a second flange part providing a gripping member, said front part of the at least one main frame member providing an abutment for said profile member and being formed to enable gripping of said second flange part in said first end position, arresting means being provided for arresting said rigid end member in a second end position in a rolled-out condition of the screening device.

12. The combination claimed in claim 11, wherein said cover member is detachably connected with said at least one main frame member.

13. The combination claimed in claim 11, wherein one of said bracket members is arranged in said cavity to be displaceable against a spring-force in the longitudinal direction of the cavity.

14. The combination claimed in claim 11, wherein said rigid end member of the screening device has a length exceeding the dimension of the light-admitting area of the window between said second pair of main frame members by respective end parts displaceably engaged in said guide tracks, each of said guide tracks having a depth sufficient to accommodate said end parts in an orientation of said rigid end member at right angles to said second pair of main frame members.

15. The combination claimed in claim 14, wherein said length is between 10 and 20 mm.

16. The combination claimed in claim 15, wherein said length is 15 mm.

17. The combination claimed in claim 14, wherein the screening web of said screening device has a width substantially equal to the length of said rigid end member.

18. The combination claimed in claim 11, wherein an openable sash structure is arranged in said main frame structure and said screening device is an insect screen.

19. The combination claimed in claim 11, wherein said screening device is a roller blind.

20. The combination claimed in claim 11, wherein the other of said first pair of main frame members is provided in the side facing the light-admitting area with a longitudinal cavity for accommodation of a second screening device of the same kind as said roller screening device, said cavity being closed at the side facing the light-admitting area by a second cover member, and said guide tracks in said second pair of main frame members receiving the rigid end members of both of said screening devices.

21. The combination claimed in claim 20, wherein the rigid end members of said first and second screening devices are provided with engaging means engageable with each other in a rolled-out condition of the screening devices, in which the screening devices together screen the light-admitting area.

22. The combination claimed in claim 20, wherein an openable sash structure is arranged in said main frame structure and one of said first an second screening devices is an insect screen and the other is a roller blind.

23. The combination claimed in claim 11, wherein said profile member is substantially L-shaped.

* * * * *